US008972096B2

(12) United States Patent
Collet

(10) Patent No.: US 8,972,096 B2
(45) Date of Patent: Mar. 3, 2015

(54) METHOD AND DEVICE FOR DETECTING THE BLOCKING OF A BLEED VALVE OF A GASOLINE VAPOR FILTER

(75) Inventor: Thierry Collet, Toulouse (FR)

(73) Assignees: Continental Automotive France, Toulouse (FR); Continental Automotive GmbH, Hannover (DE)

( * ) Notice: Subject to any disclaimer, the term of this patent is extended or adjusted under 35 U.S.C. 154(b) by 235 days.

(21) Appl. No.: 13/636,862

(22) PCT Filed: Mar. 22, 2011

(86) PCT No.: PCT/EP2011/001402
§ 371 (c)(1),
(2), (4) Date: Nov. 28, 2012

(87) PCT Pub. No.: WO2011/116927
PCT Pub. Date: Sep. 29, 2011

(65) Prior Publication Data

US 2013/0081599 A1 Apr. 4, 2013

(30) Foreign Application Priority Data

Mar. 24, 2010 (FR) ..... 10 01169

(51) Int. Cl.
*F02M 25/08* (2006.01)
*F02M 69/04* (2006.01)

(52) U.S. Cl.
CPC ..... *F02M 25/0827* (2013.01); *F02M 25/0809* (2013.01); *F02M 25/08* (2013.01); *F02M 69/044* (2013.01)
USPC ..... 701/29.1; 701/22; 701/29.6; 123/519; 123/520; 96/110

(58) Field of Classification Search
None
See application file for complete search history.

(56) References Cited

U.S. PATENT DOCUMENTS 6,371,089 B1 * 4/2002 Matsuoka et al. ..... 123/519
2005/0015194 A1 1/2005 Hassdenteufel et al.

(Continued)

FOREIGN PATENT DOCUMENTS

DE 103 24 813 A1 1/2005
DE 10 2005 048348 A1 4/2007

(Continued)

OTHER PUBLICATIONS

International Search Report, dated Apr. 29, 2011, from corresponding PCT application.

*Primary Examiner* — John R Olszewski
*Assistant Examiner* — Gerrad A Foster
(74) *Attorney, Agent, or Firm* — Young & Thompson

(57) ABSTRACT

A method and device for detecting the blocking of a bleed valve (4) of a gasoline vapor filter (3) for a vehicle internal combustion engine (1), the method includes a step of controlling the maintenance of the internal combustion engine at a constant non-idle speed during a start or pre-stop phase, and at least one sequence of the following steps when maintaining the constant speed of the internal combustion engine:

a step of changing the state of the bleed valve (4), a step of measuring at least one operating parameter of the internal combustion engine associated with the mixture fed into the engine, a step of comparing the values of the parameter measured before and after the change of state of the bleed valve and of determining if the variation of the parameter is greater than a pre-determined threshold.

7 Claims, 1 Drawing Sheet

(56) References Cited

U.S. PATENT DOCUMENTS

| | | | | |
|---|---|---|---|---|
| 2007/0079650 | A1 | 4/2007 | Streib et al. | |
| 2007/0283924 | A1 * | 12/2007 | Collet | 123/339.21 |
| 2008/0245347 | A1 | 10/2008 | Collet | |
| 2010/0162804 | A1 | 7/2010 | Grunwald et al. | |

FOREIGN PATENT DOCUMENTS

| | | | |
|---|---|---|---|
| DE | 10 2005 049068 | A1 | 4/2007 |
| EP | 2 199 586 | A2 | 6/2010 |
| FR | 2 900 981 | A1 | 11/2007 |

* cited by examiner

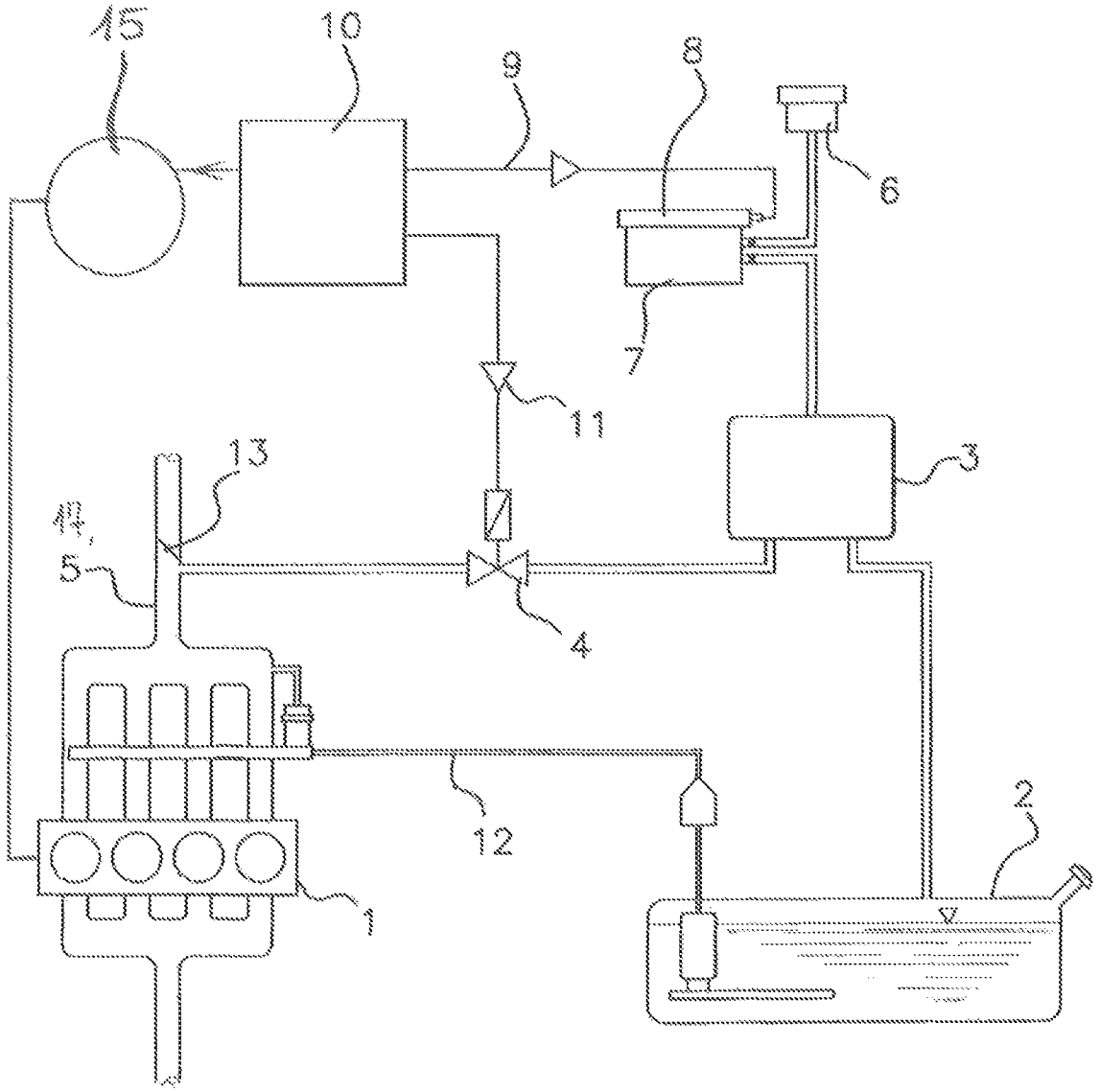
15
10
9
8
6
7
11
13
14
5
4
3
12
2
1

METHOD AND DEVICE FOR DETECTING THE BLOCKING OF A BLEED VALVE OF A GASOLINE VAPOR FILTER

BACKGROUND OF THE INVENTION

The invention relates to the field of vehicle engines. It relates more particularly to detecting the malfunction of the circuit of a gasoline vapor filter (canister) which is fitted in vehicles provided with a gasoline internal combustion engine.

For several years now and for the purpose, amongst other things, of reducing pollution generated by vehicles having a gasoline engine, and at the same time for the purpose of reducing the fuel consumption thereof, fuel tanks of said vehicles are provided with a device for recovering gasoline vapors which reinjects said vapors into the engine. This device, usually denoted the "canister" by the person skilled in the art, is arranged in the vicinity of the gasoline tank. It comprises a carbon filter which fixes the gasoline vapors, in particular when the engine is at a standstill. The injection of the vapors into the engine via the inlet duct is controlled by the electronic control unit of the engine or ECU (Engine Control Unit) permitting the opening and the closing of a bleed valve.

Current standards in some countries make it necessary to be able to detect the presence of a leak of gasoline vapors from a vehicle. This involves diagnosing any possible leaks and the malfunction of the components involved, in particular the gasoline vapor filter (canister) and the bleed valve.

Methods are known in the prior art for detecting the operation of the bleed valve using a test carried out when the vehicle is at an idle speed. In said methods, a series of openings and closings of the bleed valve are controlled over a period of approximately ten seconds. If the valve is operational, the admission of the mixture from the gasoline vapor filter into the engine has to result in the modification of various operating parameters, such as the torque, the engine speed, the intake pressure, etc. Thus it is detected if one of these parameters, which may depend on the vehicle under consideration, varies beyond a predetermined threshold, and this variation then validates the correct operation of the bleed valve of the vapor filter. Such a method is, for example, disclosed in the patent application FR 2 900 981 from Siemens VDO Automotive.

It is clear that this technique is not applicable in the case of engines using an ignition control method called "start stop" which cuts out the engine each time the vehicle is at a standstill, and as a result suppresses the idle phase of the engine. Similarly, this method is not conceivable for vehicles using a hybrid-type engine, combining an internal combustion engine (ICE) and an electric motor/generator. More specifically, said hybrid engines operate in electrical mode at low speed and thus do not have an idle engine speed permitting the verification of the operation according to the principle cited above.

SUMMARY OF THE INVENTION

The subject of the present invention, therefore, is to propose a device which remedies the problem set forth above.

A second object of the invention is to be simple and inexpensive to implement, as it uses the sensors which are already present.

To this end, the object of the invention is a method for detecting the blocking of a bleed valve of a gasoline vapor filter for a vehicle internal combustion engine, the method comprising a step of controlling the maintenance of the internal combustion engine at a constant non-idle speed, during a start or pre-stop phase, and at least one sequence of the following steps when maintaining the constant speed of the internal combustion engine:

- a step of changing the state of the bleed valve,
- a step of measuring at least one operating parameter of the internal combustion engine, associated with the mixture fed into said engine,
- a step of comparing the values of the parameter measured before and after the change of state of the bleed valve and determining if the variation of said parameter is greater than a predetermined threshold.

It goes without saying that the change of state denotes an opening or a closing of the bleed valve.

Preferably, the method comprises a repetition of the steps as disclosed above, so as to obtain a measurement which is statistically significant.

According to various arrangements which may be used in combination:

- the measurement of the operating parameter of the internal combustion engine is carried out in the region of an air intake manifold of the engine,
- the step of controlling the maintenance of the internal combustion engine at a constant non-idle speed is carried out by driving the internal combustion engine by an electric motor/generator,
- the internal combustion engine is controlled without injection during the step of controlling the maintenance of the internal combustion engine at a constant non-idle speed.

A further object of the invention is a device for detecting the blocking of the bleed valve of the gasoline vapor filter for a vehicle internal combustion engine, said device comprising:

- means for controlling the maintenance of the internal combustion engine at a constant non-idle speed during a start or pre-stop phase,
- means for measuring at least one operating parameter of the internal combustion engine associated with the mixture fed into said engine,
- means for comparing values of the parameter measured before and after a change of state of the bleed valve and determining if the variation of said parameter is greater than a predetermined threshold.

Preferably, the means for measuring at least one operating parameter of the internal combustion engine comprise at least one sensor arranged in the region of an air intake manifold of the engine.

According to an advantageous embodiment, the means for controlling the maintenance of the internal combustion engine at a constant non-idle speed comprise an electric motor/generator capable of driving the internal combustion engine.

BRIEF DESCRIPTION OF THE DRAWING

The objects and advantages of the invention will be understood more clearly by reading the description and the drawings of one particular embodiment, given by way of non-limiting example, and of which the drawings show in FIG. 1 a schematic view of the arrangement of the bleed valve of the gasoline vapor filter inside an internal combustion engine.

DESCRIPTION OF PREFERRED EMBODIMENTS

In the present example, the invention is found in a land vehicle such as an automobile, with a hybrid-type engine.

The vehicle, not shown in FIG. 1, comprises an internal combustion engine 1 supplied by fuel contained in a fuel tank 2. The internal combustion engine 1 comprises an air intake manifold 5 and a fuel inlet duct 12 connected to the fuel tank 2.

To collect the fuel vapors emanating from the fuel tank 2, said fuel tank is connected to a vapor filter 3 which is connected to the air intake manifold 5 via a bleed valve 4. The bleed valve is capable of placing the vapor filter 3 and the air intake manifold 5 of the internal combustion engine 1 in communication with one another, on command, so as to recycle at least partially the fuel vapors contained in the vapor filter 3.

The vapor filter 3 is also in communication with an air intake 6 via a vent, capable of placing the vapor filter 3 and the air intake 6 in communication with one another.

In the present non-limiting example, the vent is connected to a venting valve 7 which opens when the pressure in the vapor filter 3 exceeds a specific threshold or passes below a specific threshold. This is the case, for example, when the bleed valve 4 is open and the internal combustion engine 1 is in operation.

The vacuum created in the air intake manifold 5 suctions the fuel vapors contained in the vapor filter 3 and causes the opening of the venting valve 7. Air then passes through the vapor filter 3 and is loaded with fuel vapor before passing into the air intake manifold 5.

Still within the present non-limiting example, the venting valve 7 further comprises a pressostat 8 capable of transmitting a signal according to the level of vacuum in the vapor filter 3. The pressostat 8 delivers its signal via a line 9 to an electronic control unit 10 which may be dedicated to the system or shared with other components of the vehicle such as the internal combustion engine 1.

The electronic control unit 10 is capable of controlling the opening and closing of the bleed valve 4 via a control line 11.

In the present non-limiting exemplary embodiment, the vehicle is of the hybrid type and also comprises an electric motor/generator 15 capable of driving the internal combustion engine 1.

The method for detecting the operation of the bleed valve 4 comprises several steps.

In the present exemplary embodiment in the context of a hybrid engine, the electronic control unit 10 controls the electric motor/generator 15 to drive the internal combustion engine 1 at a constant speed during a period of several seconds (typically one to three seconds) during a start or stop phase of said internal combustion engine 1.

The internal combustion engine 1 may be controlled with or without injection (and thus with or without combustion) according to the capacity of the electric motor to drive the internal combustion engine 1.

When opening or closing the bleed valve (change of state of said valve) the electronic control unit 10 controls the throttle valve 13 controlling the quantity of intake air according to a control profile, which in theory is capable of maintaining a constant flow circulating in the cylinders.

During this stabilization phase of the engine speed and the change of state of the bleed valve 5 and the throttle valve 13, the electronic control unit 10 receives certain parameters measured in the region of the air intake manifold 5, for example the pressure in said manifold 5, the air mass flow, the quantity of intake air via the controller of the butterfly valve 13, etc. Said parameters are measured by devices 17 of the type known by the person skilled in the art.

In a variant, the electronic control unit 10 controls one or more opening and closing cycles of the bleed valve and records the measured parameters.

The two cases are thus:

- either the bleed valve 4 is blocked (in the open or closed position). In this case, in spite of the commands sent by the electronic control unit 10, the flow in the cylinders is not constant. The electronic control unit 10 thus records the parameters where the variation thereof is greater than a pre-determined threshold, which thus characterizes a malfunction of the bleed valve 4.
- or the bleed valve 4 operates correctly. In this case, the flow in the cylinders is effectively constant. The electronic control unit 10 does not detect a significant variation in the measured parameter(s).

It goes without saying that the method as disclosed above has several advantages.

It is possible detect a malfunction of the bleed valve 4 without the engine having to be at idle speed for a long period, which permits a reduction in the pollution generated by the engine during this period.

The detection of the operation may be carried out during a stop phase of the engine, extended by several seconds, which does not impair the performance of the automobile when driven.

Given that the internal combustion engine 1 is controlled by the electric motor/generator, it is possible to obtain an operating point (control of the flow circulating in the cylinders) which is particularly stable, which is translated into a very accurate diagnosis of the operation of the bleed valve 4, the variability of the measured parameters being low, without the effect of a malfunction of the bleed valve 4.

The scope of the present invention is not limited to the details of the embodiments above, considered by way of example, but extends to modifications within the scope of the person skilled in the art.

In a variant, the invention may be implemented in the case of a vehicle which is not hybrid but which comprises a mechanism for controlling stoppage periods of the "start-stop" type. In this case, the electronic control unit controls the internal combustion engine 1 at a constant speed during the start or stop phase of the engine. The remainder of the method is unchanged.

The invention claimed is:

1. A method for detecting blocking of a bleed valve (4) of a gasoline vapor filter (3) for a vehicle internal combustion engine (1), the method comprising:

an electronic control unit (10) controlling maintenance of the internal combustion engine (1) at a constant non-idle speed, during a start or pre-stop phase; and at least one sequence of the following steps when maintaining the constant speed of the internal combustion engine (1):

changing the state of the bleed valve (4), measuring at least one operating parameter of the internal combustion engine (1) associated with the mixture fed into said engine (1) before and after changing the state of the bleed valve (4), and comparing the values of the parameter measured before and after the change of state of the bleed valve (4) and determining if the variation of said parameter is greater than a pre-determined threshold, wherein the step of controlling the maintenance of the internal combustion engine (1) at a constant non-idle speed is carried out by driving the internal combustion engine (1) by an electric motor/generator (15).

2. The method as claimed in claim 1, further comprising a repetition of the steps as disclosed above, so as to obtain a measurement which is statistically significant.

3. The method as claimed in claim 1, wherein the measurement of the operating parameter of the internal combustion engine (1) is carried out in the region of an air intake manifold (5) of the engine.

4. The method as claimed in claim 1, wherein the internal combustion engine (1) is controlled without injection during the step of controlling the maintenance of the internal combustion engine (1) at a constant non-idle speed.

5. A device for detecting blocking of a bleed valve (4) of a gasoline vapor filter (3) for a vehicle internal combustion engine (1), said device comprising:

means for controlling maintenance of the internal combustion engine (1) at a constant non-idle speed during a start or pre-stop phase, means for measuring at least one operating parameter of the internal combustion engine (1) associated with the mixture fed into said engine (1), and means for comparing values of the parameter measured before and after a change of state of the bleed valve (4) and determining if the variation of said parameter is greater than a pre-determined threshold, wherein the means for controlling the maintenance of the internal combustion engine (1) at a constant non-idle speed comprise an electric motor/generator (15) capable of driving the internal combustion engine (1).

6. The device as claimed in claim 5, wherein the means for measuring at least one operating parameter of the internal combustion engine (1) comprise at least one sensor (17) arranged in the region of an air intake manifold (5) of the engine.

7. The method as claimed in claim 2, wherein the measurement of the operating parameter of the internal combustion engine (1) is carried out in the region of an air intake manifold (5) of the engine.

* * * * *